United States Patent [19]

Dula

[11] Patent Number: 4,629,155

[45] Date of Patent: Dec. 16, 1986

[54] IN-SITU POST HOLE FORMING DEVICE

[75] Inventor: Fred P. Dula, Charlotte, N.C.

[73] Assignee: Dula-Wright, Inc., Charlotte, N.C.

[21] Appl. No.: 716,360

[22] Filed: Mar. 26, 1985

[51] Int. Cl.[4] ..... B28B 7/34

[52] U.S. Cl. ..... 249/61; 52/297; 52/577; 52/707; 249/134; 249/175; 249/176; 249/219 R

[58] Field of Search ..... 249/210, 211, 207, 212, 249/219 R, 183, 143, 177, 176, 175, 51, 61, 62, 63, 64, 120, 122, 134, 139, 153; 52/729, 730, 732, 823, 297, 298, 577, 578, 699, 707

[56] References Cited

U.S. PATENT DOCUMENTS

| | | | |
|---|---|---|---|
| 2,407,441 | 9/1946 | Painter, Jr. | 249/176 |
| 3,205,634 | 9/1965 | Wagner | 52/577 |
| 3,276,176 | 10/1966 | Jonsson et al. | 52/577 |
| 3,471,117 | 10/1969 | Haney | 249/176 |
| 3,632,078 | 1/1972 | Dashew | 249/176 |
| 3,810,339 | 5/1974 | Russo | 52/297 |
| 3,912,217 | 10/1975 | Norlander | 249/176 |
| 4,124,959 | 11/1978 | Hill | 52/297 |

*Primary Examiner*—Jay H. Woo
*Assistant Examiner*—James C. Housel
*Attorney, Agent, or Firm*—Shefte, Pinckney & Sawyer

[57] ABSTRACT

The disclosure is directed to a device for forming a post-receiving cavity in a solid material during the solidification thereof with the device including a clamping element having first and second side walls disposed in facing relationship to each other, with each of the side walls having a vertical extent, and a resilient wall which extends between the first and second side walls and interconnects the first and second side walls intermediate the respective vertical extent of each side wall to thereby divide each side wall into an upper end portion and a lower basal portion. The resilient wall is constructed and configured to cause the upper end portions of the side walls to move outwardly in response to application of an inward lateral force to the lower basal portions of the side walls and also to cause the upper end portions of the side walls to be maintained at a predetermined distance from each other in the absence of any inward lateral force being applied to the lower basal portions. The device also includes a post-receiving cavity from which is made of deformable material and which has at least one dimension that is greater than or equal to the predetermined distance which the resilient wall normally maintains between the upper end portions of the side walls and which is disposed between the upper end portions. The post-receiving cavity form is selectively disposed between the upper end portions so that the dimension of the post-receiving cavity form which is greater than or equal to the predetermined distance between the upper end portions so that the post-receiving cavity form is biasingly retained between the upper end portions by its engagement with the upper end portions.

14 Claims, 8 Drawing Figures

38
14
10
34
28
22
16
36
26
20
34
20
18
36
30
22
24
12
30
PRIOR ART 76
74
48
76
66

FIG. 7
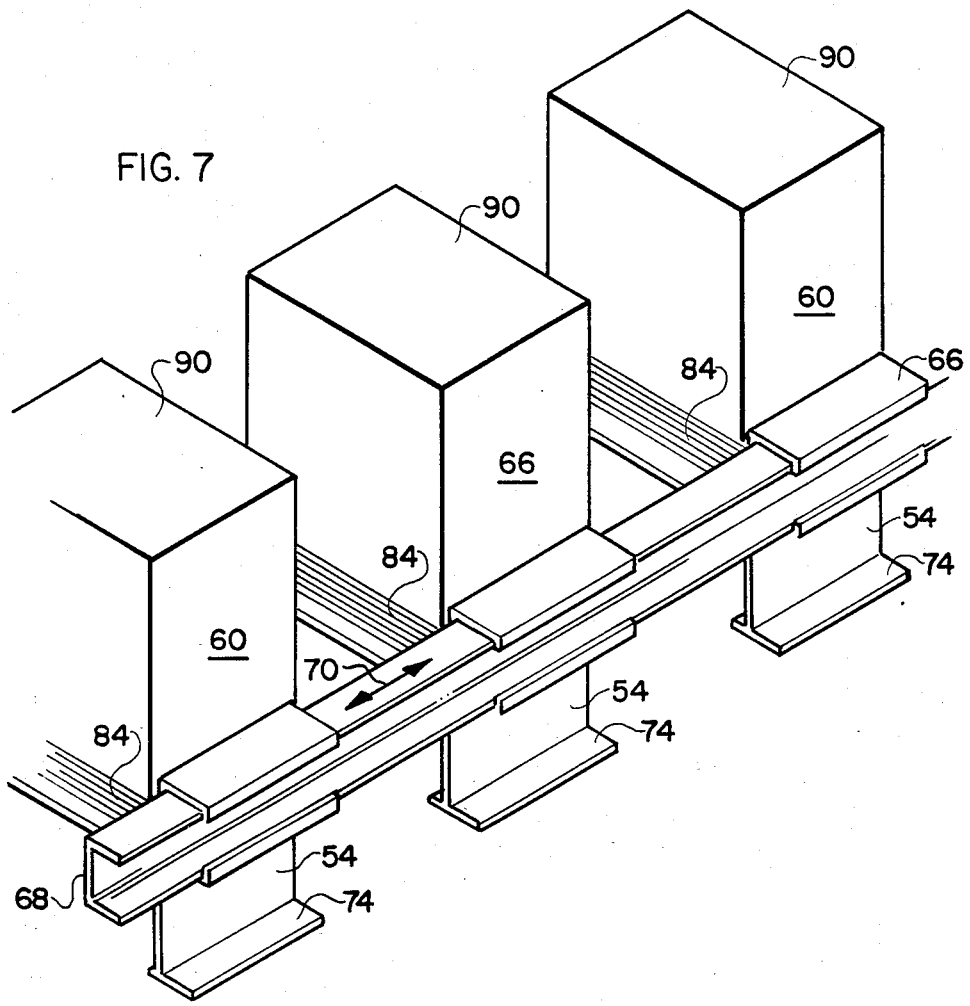
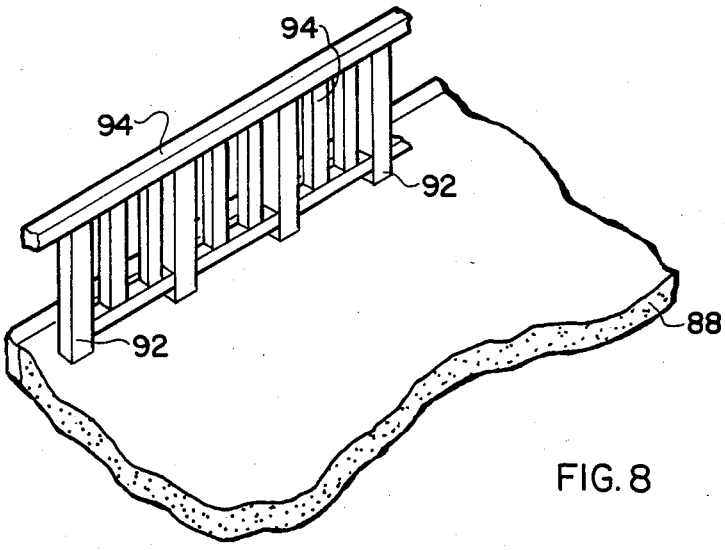
FIG. 8

IN-SITU POST HOLE FORMING DEVICE

BACKGROUND OF THE INVENTION

This invention generally relates to a device for selectively forming a post hole cavity in a material during the solidification of the material with the hole or cavity being designed to receive a post or any other type of stanchion. In the past, post holes or cavities which were provided in a solid material such as a poured concrete slab were formed by core drilling the slab at appropriate locations after the slab had solidified. This procedure proved to be both time consuming and expensive. Accordingly, those in the art have attempted to obviate this problem by utilizing post hole forming devices which formed the post-receiving cavity or hole during solidification of the concrete slab as opposed to after solidification thereof. One such device is disclosed in U.S. Pat. No. 4,255,913 to Poma. This patent discloses utilization of a hollow sleeve bracket member to form the post-receiving cavity by first positioning the bracket on the reinforcing rods or mesh upon which the concrete will be poured and then pouring the concrete into a retaining (or shaping) mold which is positioned on the reinforcing rods up to a height not to exceed the top of the hollow bracket. Upon solidification of the concrete the bracket defines a post-receiving cavity into which a L-shaped post is placed and bolted to the bracket. The patent also discloses that a plurality of the devices may be selectively positioned with respect to each other by connecting them to stringers or runners. While this system may perform adequately, it suffers from several drawbacks. One such drawback is that the workers utilizing the device must be careful not to pour the concrete material directly into the interior of a hollow bracket or, for that matter, to pour an amount of concrete into the concrete retaining mold, which would result in the concrete flowing over the top edge of the bracket and down into its interior. Another disadvantage is that a mechanism bolting operation to secure the post within the hollow bracket is necessary, and since this bolting operation must occur down inside the hollow bracket and by those in the field, it is time consuming and requires significant labor.

Another prior device which has been utilized to form a post-receiving hole or cavity within a concrete slab during its solidification is illustrated in FIG. 1. This device generally includes a support arrangement for positioning and holding a post-receiving cavity form which is selectively removable from the support arrangement. The post-receiving cavity form of this prior device maybe generally described as an inverted generally rectangular shaped cup the lower edge of which has been provided with two outwardly projecting tabs on the opposite sides thereof. The projecting tabs are configured to be inserted into two corresponding recesses in the sides of the support arrangement. Such insertion may occur either slidingly by laterally aligning the tabs and recesses and applying lateral force or by a "snap-fit" insertion by pressing the post-receiving cavity form downward into the support arrangement and between the side walls thereof with the outwardly projecting tabs passing downwardly along the inner surface of the side walls of the support structure until they snap into their respective recesses. In use, the thus assembled combination of the support structure in the post-receiving cavity form is selectively placed in a manner essentially equivalent to the above-described placement of the hollow bracket of the Poma patent wherever formation of a post hold is desired. A plurality of these devices may be selectively positioned with respect to each other by inserting a support channel of steel or other material into one of the retaining channels which project from the exterior surfaces of the side walls of the support structure. Thereafter, the concrete or other appropriate material is poured, as discussed above, into the mold up to a level not exceeding the top of the post-receiving cavity form. After the concrete has solidified, the post-receiving cavity form is forcibly disengaged from the support structure and the concrete generally by piercing the top of the support-receiving cavity form and pulling upwards to disengage the tabs from their respective recesses. While this device appears to be an improvement over the Poma device, it too is subject to certain drawbacks and disadvantages. One such drawback is that a relatively large number of post-receiving cavity forms having various depths must be maintained in stock due to the fact that the depth of the concrete slab will vary depending upon the application in which it will be utilized. That is, deeper post-receiving cavity forms will be necessary for applications requiring concrete slabs of increased depth since the top of the post-receiving cavity form must protrude out from the concrete after it has been poured. Another disadvantage of this device is that it is difficult to disengage the tabs from their respective recesses after the concrete has solidified when it is desired to remove the post-receiving cavity form from the support structure to reveal the post hole or cavity which has been formed within the concrete. Such difficulty can result in time delays and increased labor costs in removing each post-receiving cavity form from its respective support structure and the concrete slab.

SUMMARY OF THE INVENTION

The present invention, which has been developed to overcome the above-discussed disadvantages, encompasses a device for forming a post-receiving cavity in a material during the solidification of the material. In particular, the device includes a clamping arrangement having first and second side walls disposed in facing relationship to each other, with each of the side walls having a vertical extent, and a resilient wall which extends between the first and second side walls and interconnects the first and second side walls intermediate the respective vertical extents of each side wall so as to divide each side wall into an upper end portion and a lower basal portion. The resilient wall is constructed and configured to cause the upper end portions of the side walls to move outwardly in response to the application of an inward lateral force to the lower basal portions of the side walls and also to cause the upper end portions of the side walls to be maintained at a predetermined distance from each other in the absence of any lateral force being applied to the lower basal portions of the side walls. The lower basal portions of the side walls may include a generally planar foot portion which is adapted to support the device in a substantially upright position. The lower surface of the foot portion may be grooved to assist the foot portion in obtaining a good purchase or grip of the surface on which the foot portion is placed.

Also included within the device is a post-receiving cavity form which has at least one dimension that is greater than or equal to the predetermined distance which the resilient wall normally maintains between the upper end portions of the side walls and which is disposed between the upper end portion of the sidewalls. The post-receiving cavity form is disposed between the upper end portions so that the dimension of the post-receiving cavity form which is greater than or equal to the predetermined distance between the upper end portions of the side wall extends between the upper end portions so that the post-receiving cavity form is biasingly retained between the upper end portions of the side walls by its engagement with the upper end portions.

In one embodiment of the present invention at least one of the upper end portions of the side walls includes an engaging portion which projects outwardly from an upper end portion towards the facing upper end portion, and the post-receiving cavity form is constructed from a deformable material. In this embodiment the post-receiving cavity form is biasingly retained between the upper end portions by its engagement with the projecting engaging arrangement which deformingly engages the post-receiving cavity form.

In another embodiment of the present invention at least one of the upper end portions of the side walls also includes an engaging portion which projects outwardly from an upper end portion toward the facing upper end portion and the post-receiving cavity form is constructed from a penetratable material. In this embodiment, the post-receiving cavity form is biasingly retained between the upper end portions of the side walls by its engagement with the projecting engagement which penetratingly engages the penetratable post-receiving cavity form. In any of the embodiments of the present invention which include the engaging means, one or more engaging means may project from one or more of the upper end portions of the side walls.

In one embodiment of the present invention, the first and second side walls and the resilient wall are each planar so that each of the upper end portions of the side walls form an angle between the resilient wall with at least one of the angles being, in the absence of any inward lateral force being applied to the lower basal portions of the side walls, less than 90 degrees. In this regard each angle formed between each of the upper end portions and the resilient wall may be, in the absence of any inward lateral force being applied to the lower basal portions of the side walls, less than 90 degrees. Preferrably, the angles which are less than 90 degrees are the same.

If stronger engagement of the upper end portions with the post-receiving cavity form is desired the device of the present invention may further include a band which contactingly and tightly encircles the upper end portions of the side walls and the post-receiving cavity form. The band, which may be formed from conventional adhesive tape that has been encirclingly adhered to the upper end portions and the post-receiving cavity form, assists in the engagement of the upper end portions with the post-receiving cavity form.

BRIEF DESCRIPTION OF THE DRAWINGS

FIG. 7 is a perspective view of a group of devices for forming a post-receiving cavity in a solid material during its solidification and which are designed and constructed in selectively connected and positioned along the longitudinal extent of a steel channel member.

FIG. 8 is a perspective view showing a railing which has been erected in a concrete slab by utilizing post-receiving cavity forming devices designed and constructed in accordance with the present invention.

DETAILED DESCRIPTION OF THE PREFERRED EMBODIMENT

Figure 1:
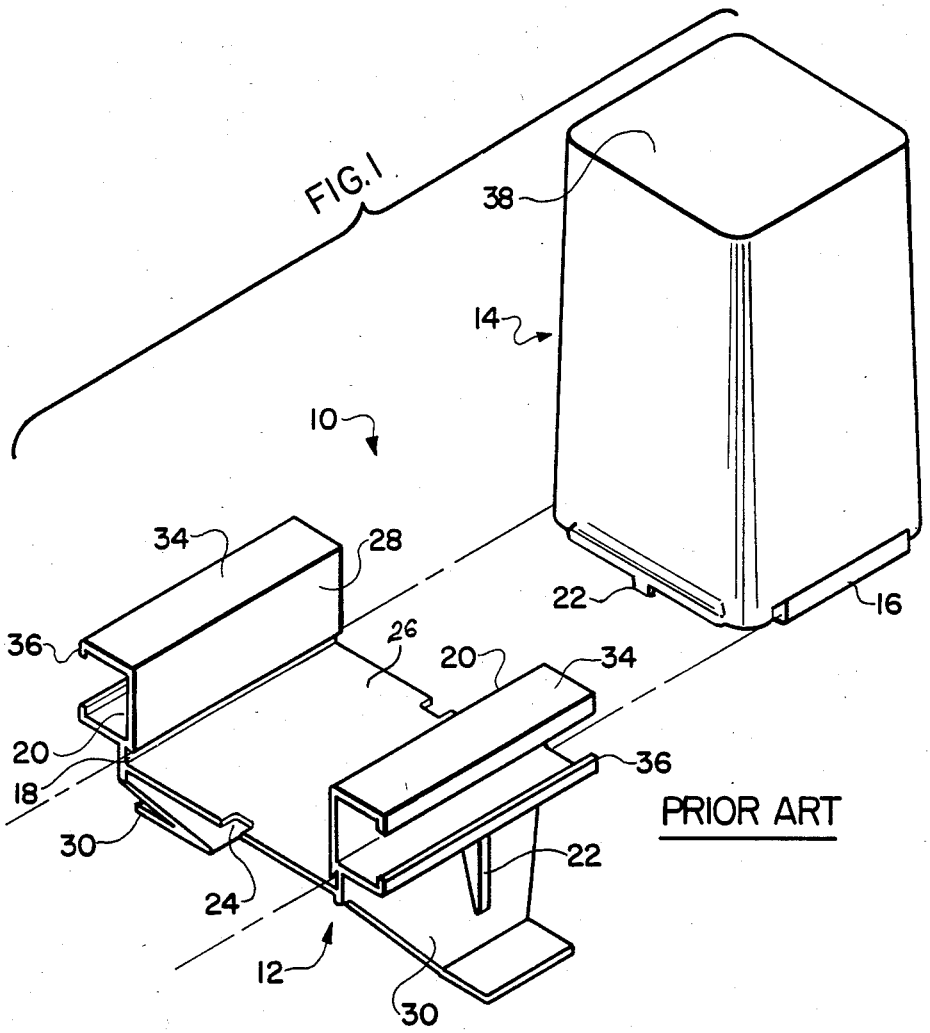
FIG. 1 is an exploded perspective view of a prior device for forming a post-receiving cavity in a solid material during the solidification thereof.

Turning now to the drawings wherein like reference numerals designate the same or equivalent structure and, in particular, to FIG. 1 which is a laterally exploded perspective view of one of the above-discussed prior post-receiving cavity forming devices 10 which is adapted for utilization in the formation of a post-receiving cavity or hole in a material, such as concrete, during the solidification of the material. The device 10 includes a support arrangement 12 and a post-receiving cavity form 14 which is selectively separable from the support arrangement 12. The form 14 is configured and positioned as an inverted generally rectangular cup which includes a pair of outwardly projecting tabs 16 on the opposite sides thereof, and downwardly extending projection 22. The two tabs 16 are configured to be inserted into two corresponding recesses 18 which are located in the sides 20 of the support arrangement. Upon such insertion of projections 22 of the form 14 will be received within the notches 24 of the support arrangement 12. The support arrangement 12 also includes a wall 26 which interconnects the two side walls 20 of the support arrangement 12, and each of the lower basel portions 30 is braced by an outer reinforcing strut 32 and an inner reinforcing strut (not shown) which extends between the inner surface of each lower basal portion 30 and the lower surface of the resilient wall 26. Each of the side walls 20 of the support arrangement 12 also include a generally U-shaped retaining configuration 34 having a pair of generally L-shaped arm portions 36 that are disposed in facing relationship to each other and which extend laterally outwardly from the respective side walls 20 so that each retaining configuration 34 is adapted to retainingly engage a steel channel member (not shown) having a longitudinal extent. Accordingly, a plurality of the devices 10 may be selectively positioned along the longitudinal extent of the steel channel member, as desired.

To use the prior device 10, the form 14 is engaged within the support arrangement 12 upon insertion of the tabs 16 into the recesses 18, and insertion of the projections 22 within the notches 24. The thus assembled device 10 will be placed where a solid concrete slab is to be formed and at a point where formation of a post-receiving cavity or hole is desired. If a railing or other arrangement requiring a group of uniformly spaced and arranged posts to be formed, a plurality of the devices may engage a steel channel member (not shown) and be positioned therealong as desired. Therefore the concrete is poured up to a height which is lower than the top 38 of the form 14 so that the top 38 of the form 14 remains visible. After solidification of the concrete, the top 38 of the form 14 is normally pierced by a sharp tool and the form 14 is forcibly extracted from the support 12 and the surrounding solid concrete to reveal a post-receiving hole which was formed as a result of the exclusion of the concrete from within the interior or the form 14. Thereafter, an appropriate post or other type or stanchion may be conventionally mounted within the form cavity. Unfortunately, as was stated above, this prior device 10 suffers from several drawbacks, the most vexing of which may be the difficulty which has been encountered by those in the field in removing the form 14 from the surrounding concrete and the support arrangement 12 since disengagement of the tabs 16 of the form 14 from the recesses 18 of the support arrangement 12 is difficult. An additional difficulty which has been encountered is in initially properly engaging the tabs 16 and the projections 22 of the form 14, respectively, into the recesses 18 and the notches 24 of the support arrangement 12. Also, the construction of support 12 and the form 14 is such that both elements must be molded, which significantly increases the cost of the device 10 as compared, for example, with extruded plastic elements. Finally, the nature of the forms 14 is such that users thereof must ordinarily maintain a relatively large inventory of form 14 having different sizes so that they can be used with concrete slab formed of varying depths.

Figure 2:
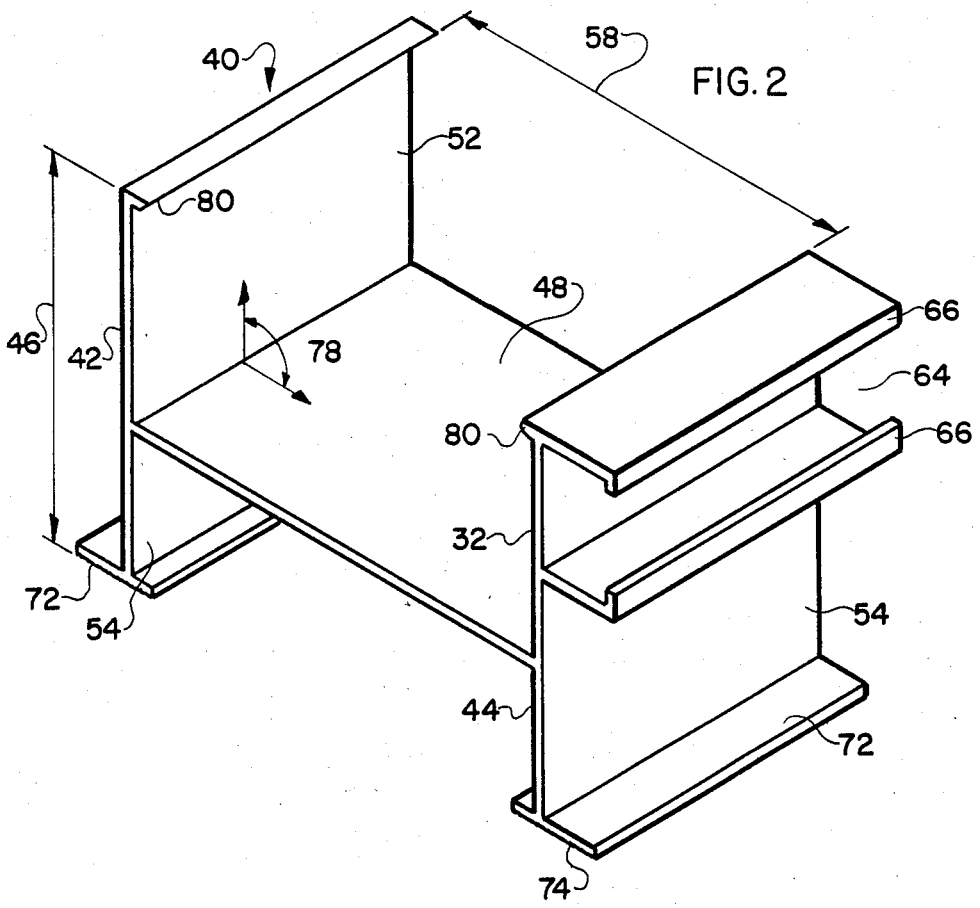
FIG. 2 is a perspective view of a clamping arrangement designed and constructed in accordance with the present invention.

The cavity-forming device 50 of the present invention includes a clamping element 40 which, at best seen in FIG. 2, includes first and second side walls 42, 44 which are disposed in facing relationship to each other and which each have a vertical extent 46. A resilient wall 48 extends between and interconnects the first side wall 42 to the second side wall 44 intermediate the vertical extent 46 of each side wall so as to divide each side wall into an upper end portion 52 and a lower basal portion 54. The resilient wall 48 is formed from a resilient material, preferably an extrudable resilient plastic material, and is constructed and configured to cause the upper end portions 52 of the side walls 42, 44 to move outwardly in response to the application of an inner lateral force 56, indicated by arrows 56 in FIG. 4, to the lower basal portions 54 of the side walls 42, 44. The resilient wall 48 is also constructed and configured to maintain the upper end portions 52 of the side walls 42, 44 at a predetermined distance 58 from each other in the absence of any application of lateral force to the lower basal portions 54 of the side walls. In other words, the resilient wall 48 is adapted to flex in response to an application of force 56 to the lower basal portions 54 of the side walls 42, 44 but, as a result of its resiliency, will, return the upper end portions 52 of the side walls 42, 44 to the original predetermined distance 58 upon termination of the application of the lateral force 56 to the lower basal portions 54.

Figure 5:
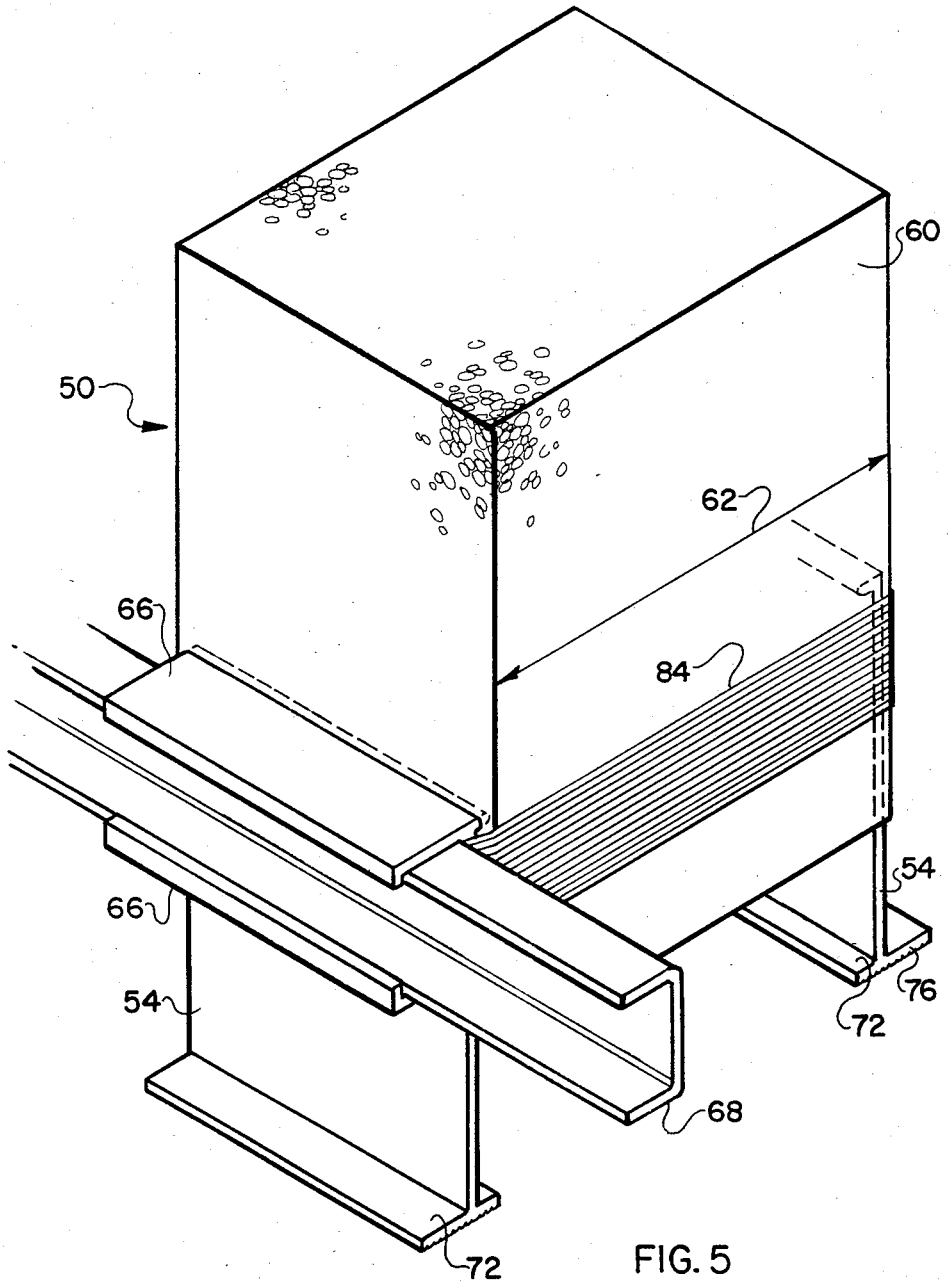
FIG. 5 is a perspective view of an in-situ post hole forming device constructed in accordance with the teachings of the present invention and which has been connected to and positioned on the longitudinal extent of a steel channel member.

The device 50 of the present invention also includes a post-receiving cavity form 60 which, as best seen in FIG. 5, is preferably a rectangular block of a material which has at least one dimension 62 which is greater than or equal to the predetermined distance 58 which is normally maintained between the upper end portions 52 by the resilient wall portion 48. The post-receiving cavity form 60 is disposed between the upper end portion 52 so that the dimension 62 extends between the upper end portions 52 whereby the cavity form 60 is retained between the upper end portions of the side walls 42, 44 by the biasing force imposed upon the side walls 42, 44 by the resilient wall 48 which, as a result of its resiliency, tends to return the clamping element 40 to its normal, unstressed, unbiased configuration illustrated in FIG. 2.

Figure 3:
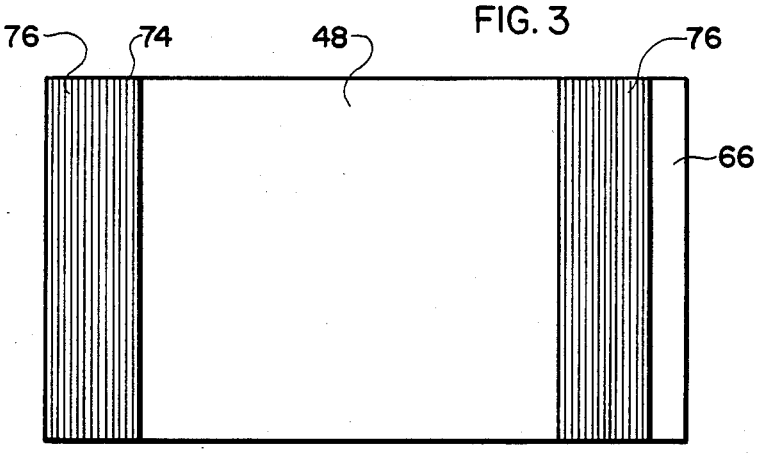
FIG. 3 is a bottom view of the clamping arrangement of FIG. 2.

At least one of the side walls 42, 44 of the clamping element 40 may also include a generally U-shaped retaining configuration 64 which has a pair of generally parallel L-shaped arm portions 66 disposed in facing relationship to each other and which extend laterally outwardly from that side wall so that the retaining configuration is adapted to retainingly engage a conventional steel channel member 68, as shown in FIG. 5, having a longitudinal extent 70 so that a plurality of the devices 50 may be selectively positioned along the longitudinal extent 70 of the steel channel member 68, as desired. The lower basal portions 54 of the clamping arrangement 40 preferrably include a generally planar foot portion 72 which is adapted to support the device 50 in a substantially upright position, and the surface of the foot portion 74 (see FIG. 3) may be grooved as at 76 to assist the foot portion 72 in obtaining a good purchase or grip on the surface upon which it is placed.

In one embodiment of the present invention, the first and second side walls 42, 44 and the resilient wall 48 are each substantially planar so that the upper end portion 52 of the side walls 42, 44 each form an angle 78 between the resilient wall 48 with at least one of the angles 78 being, in the absence of any inward lateral force 56 being applied to the lower basal portions 54 of the side walls 42, 44, less than 90 degrees. In this regard, it is generally preferable that both of said angles 78 be less than 90 degrees and it is particularly preferably that both of the angles 78 be less than 90 degrees and of the same magnitude. This angular configuration of the side walls 42, 44 provides a better grip on the cavity form 60.

Figure 4:
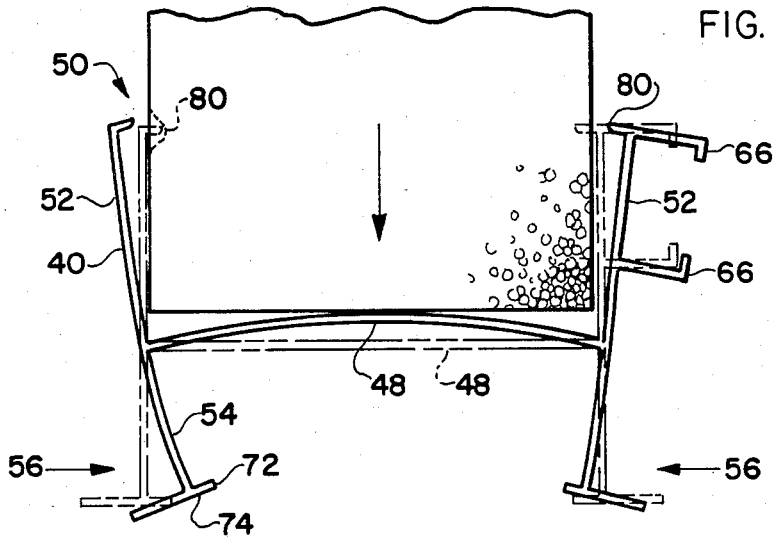
FIG. 4 is a perspective view of the clamping arrangement of FIG. 1 illustrating the configuration which the clamping arrangement assumes upon the application of an inward lateral force to the lower basal portions of the clamping arrangement.

In a preferred embodiment of the present invention, at least one of the upper end portions 52, and preferably both, of the side walls 42, 44 include an engaging element 80 which projects out from that upper end portion 52 towards the other, facing upper end portion 52. In this embodiment of the invention, the cavity form 60 is preferrably formed from either a deformable material or a penetratable material so that the engaging elements 80 will either deformingly engage the cavity form 60 or penetratingly engage the cavity form 60. This combination of materials for the cavity form 60 and the presence of the engaging arrangement 80 projecting from the upper end portions 52 of the side walls 42, 44 greatly assists the side walls 42, in biasingly retaining the cavity form 60 between the upper end portion 52 of the side walls 42, 44 upon disposition of the cavity form 60 between the upper end portions 52 with the dimension 62 extending between the upper end portions as depicted in FIG. 4. In particular, FIG. 4 illustrates, in dotted lines at the left-hand margin, a configuration which will result when the cavity form 60 is formed from a deformable material. In this instance the cavity form 60 has been inwardly deformed by the engaging arrangement 80 as at 82. Alternately, the configuration illustrated at the right-hand margin of FIG. 4 is one which is arrived at if the cavity form 60 is formed from a penetratable material. In this instance, the engaging arrangement 80 would physically penetrate into the cavity form 60. Exemplary deformable material include, without limitation, a wide variety of plastic materials. A particularly preferred and exemplary pentratable material is an expanded cellular polystyrene available under the trademark "STYROFOAM." For reasons that will be discussed below, the penetratable styrofoam material has additional advantages in that it is easily and readily dissolved by a variety of petroleum dissolute products such as gasoline, for example, and in that it can be readily cut to any desired length. Accordingly, users of the present device 50 need only stock a few long pieces of the styrofoam material and then, on-site, cut the long stock material to form cavity forms 60 of the desired depth. The requirement that a large inventory of the wide variety of different sized forms 60 is thus avoided.

As illustrated in FIG. 5, the retaining purchase of the clamping element 40 on the cavity form 60 may be increased, when desired or necessary, by utilizing a strip or band of material 84 that is tightly wrapped around the side walls 42, 44 and the cavity form 60 to maintain the side walls 42, 44 in their holding disposition in contact with the cavity form 60. This strip of material 84 is preferably an adhesive tape which will adhere to the surfaces of the side walls 42, 44 and the cavity form 60.

Figure 6:
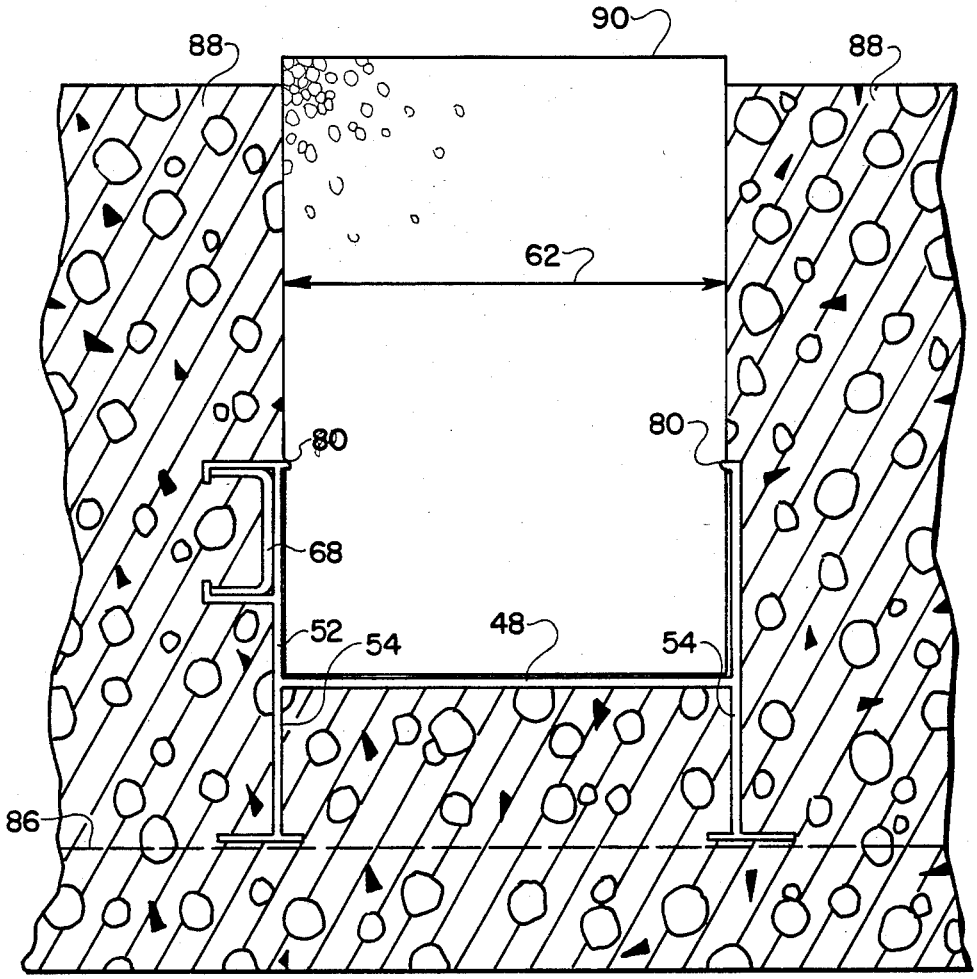
FIG. 6 is a cross-sectional view of a device constructed in accordance with the present invention and which is disposed within a concrete slab.

FIG. 6 illustrates the device 50 of the present invention in cross-sectional detail in the configuration that the device would assume after it has been placed to form a post-receiving cavity or other hole in a material during the solidification of the material. In particular, FIG. 6 illustrates the device 50 after it has been placed on a group of wire mesh rods or filaments 86 and concrete 88 has been poured onto the wire mesh 86 which is surrounded by a slab shaping form (not shown) that defines the final shape of the slab. The concrete 88 has been poured to a height which is not quite as high as the top 90 of the cavity form 60, which leaves the top 90 of the cavity form 60 visible and available for extraction from the concrete 88 and the clamping arrangement 40. If the cavity form 60 is formed from a penetratable material such as, for example, "STYROFOAM" material which is readily dissolvable by a petroleum distilate product an added advantage of the present invention is that the form 60 may be readily removed from the concrete 88 through application of a small quantity of a petroleum distilate product, such as gasoline, which simply dissolves the STYROFOAM material. Alternatively, such material, as is well known, is quite soft and can be readily and easily chipped or gouged out of the concrete 88.

FIG. 7 generally illustrates a plurality of the devices 50 constructed in accordance with the teachings of the present invention which have been arranged along the longitudinal extent 70 of a steel channel member 68. This arrangement allows those in the field to uniformly position the devices 50 along a steel channel member 68 so that the post-receiving cavities are uniformly placed as desired, within the concrete 88. The steel channel member 68 may be straight or may comprise curved configurations depending upon the shape of the railing or other post utilizing structure which is to be mounted in the concrete slab 88.

FIG. 8 is a perspective view of a group of railing posts 92 which have been mounted in a concrete slab 88 through utilization of the device 50 of the present invention. The posts 92 are generally supporting a picket rail 94. Of course, other appropriate post or other post/railing configurations such as, for example, a wrought iron railing configuration could be utilized, if desired.

The elements of the present invention might be combined in many alternate configurations other than those disclosed in the present description and drawings, and the particular embodiments disclosed in full detail herein and illustrated in the drawings have been provided for disclosure purposes only and are not intended to limit the scope of the present invention, which is to be determined by the scope of the appended claims.

I claim:

1. A device for forming a post-receiving cavity in a material during the solidification of the material of, said device comprising:

clamping means including:

first and second side wall means disposed in facing relationship to each other, each of said side wall means having a vertical extent;

resilient wall means extending between the first and second side wall means and interconnecting said first and second side wall means intermediate the vertical extents thereof to divide each side wall means into an upper end portion and a lower basal portion forming a base for said device;

wherein the resilient wall means is adapted to cause the upper end portions to move downwardly in response to application of inward lateral force to said lower basal portions and to cause the upper end portions to be maintained at a predetermined distance from each other in the absence of said inward lateral force being applied to said lower basal portions; and post-receiving cavity form means formed of a material deformable by said upper end portions and having at least one dimension greater than or equal to said predetermined distance and being disposed between said upper end portions;

wherein the post-receiving cavity form means is disposed between said upper end portions so that said one dimension extends between and is deformingly engaged by said upper end portions to be biasingly retained therebetween.

2. The device according to claim 1, wherein the first and second side wall means and the resilient wall means are each substantially planar and each of said upper end portions forms an angle between the resilient wall means and at least one of said angles is, in the absence of said inward lateral force, less than 90 degrees.

3. The device according to claim 2, wherein each angle formed between each upper end portion and the resilient wall means is, in the absence of said lateral force, less than 90 degrees.

4. The device according to claim 1, further comprising band means wrapped around the upper end portions of said first and second side wall means and said post-receiving cavity form means, said band means being adapted to assist said engagement of said upper end portions with said post-receiving cavity form means.

5. The device according to claim 4, wherein said band means comprises a strip of adhesive tape which is adhered to the upper end portions of said first and second side wall means and said post-receiving cavity form means.

6. The device according to claim 1 wherein said deformable material comprises an expanded cellular polystyrene material.

7. A device for forming a post-receiving cavity in a material during the solidification of the material, said device comprising:

clamping means including:

first and second side walls means disposed in facing relationship to each other, with each of said side wall means having a vertical extent;

resilient wall means extending between the first and second side wall means interconnecting said first and second side wall means intermediate the vertical extents thereof to divide each side wall means into an upper end portion and a lower basal portion, and with at least one of said upper end portions including engaging means projecting out from said upper end portion toward the facing upper end portion;

wherein the resilient wall means is adapted to cause the upper end portions to move outwardly in response to application of inward lateral force to said lower basal portions and to cause the upper end portions to be maintained at a predetermined distance from each other in the absence of said inward lateral force being applied to said lower basal portions; and post-receiving cavity form means made from a material penetratable by said engaging means and having at least one dimension greater than or equal to said predetermined distance and being disposed between said upper end portions;

wherein the post-receiving cavity form means is disposed between said upper end portions so that said one dimension extends between said upper end portions and is penetratingly engaged by said engaging means to be biasingly retained between said upper end portions.

8. The device according to claim 7, wherein the first and second side wall means and the resilient wall means are each substantially planar and each of said upper end portions forms an angle between the resilient means and at least one of said angles is, in the absence of said inward lateral force, less than 90 degrees.

9. The device according to claim 8, wherein each angle formed between each upper end portion and the resilient wall means is, in the absence of said lateral force, less than 90 degrees.

10. The device according to claim 7, wherein each of the upper end portions includes an engaging means projecting out from said upper end portion toward the facing upper end portion and said penetratable post-receiving cavity form means is biasingly retained between said engaging means by engagement with both of said engaging means, with both of said engaging means penetratingly engaging said post-receiving cavity form.

11. The device according to claim 7, and further comprising band means wrapped about the upper end portions of said first and second side wall means and said post-receiving cavity form means, said band means being adapted to assist said engagement of said upper end portions with said post-receiving cavity form means.

12. The device according to claim 11, wherein said band means comprises a strip of adhesive tape which is encirclingly adhered to the upper end portions of said first and second side wall means and said post-receiving cavity form means.

13. The device according to claim 7, and further characterized in that said post-receiving cavity form means is formed of a material which will dissolve when contacted by a petroleum distilate solution.

14. The device according to claim 7 wherein said penetratable material comprises an expanded cellular polystyrene material.

* * * * *

UNITED STATES PATENT OFFICE

CERTIFICATE OF CORRECTION

Patent No. 4,629,155 Dated December 16, 1986

Inventor(s) Fred P. Dula

It is certified that error appears in the above-identified patent and that said Letters Patent are hereby corrected as shown below:

Col. 4, Line 49, delete "basel" and insert therefor — basal — .

Col. 5, Line 7, delte "Therefore" and insert therefor — Thereafter — .

Col. 8, Line 30, delete "downwardly" and insert therefor — outwardly — .

Abstract, Line 20, delete "from" and insert therefor — form — .

Abstract, Line 29, between "portions" and "so" insert — extends between the upper end portions — .

Signed and Sealed this

Fifth Day of January, 1988

*Attest:*

DONALD J. QUIGG

*Attesting Officer*

*Commissioner of Patents and Trademarks*